US005095299A

United States Patent [19]

Wakamatsu

[11] Patent Number: 5,095,299

[45] Date of Patent: Mar. 10, 1992

[54] POTENTIOMETER

[75] Inventor: Kenichi Wakamatsu, Hyogo, Japan

[73] Assignee: Mitsubishi Denki Kabushiki Kaisha, Tokyo, Japan

[21] Appl. No.: 757,608

[22] Filed: Sep. 11, 1991

[30] Foreign Application Priority Data

Nov. 14, 1990 [JP] Japan ..... 2-310379

[51] Int. Cl.[5] ..... H01C 10/38

[52] U.S. Cl. ..... 338/182; 338/167; 338/170

[58] Field of Search ..... 338/170, 167, 166, 169, 338/182, 160, 183, 36, 42

[56] References Cited

U.S. PATENT DOCUMENTS

| | | | |
|---|---|---|---|
| 3,477,057 | 11/1969 | Bang | 338/182 |
| 3,932,831 | 1/1976 | Shirley et al. | 338/182 X |
| 4,198,030 | 4/1980 | Jackson et al. . | |
| 4,357,592 | 11/1982 | Okuya | 338/176 X |
| 4,420,273 | 12/1983 | Blessing et al. | 338/176 X |
| 4,473,814 | 9/1984 | Blessing | 338/176 X |
| 4,599,671 | 7/1986 | Kemeny et al. | 338/176 X |
| 4,665,376 | 5/1987 | Heinrich | 338/182 X |

FOREIGN PATENT DOCUMENTS

| | | |
|---|---|---|
| 62-6650 | 2/1987 | Japan . |
| 63-30770 | 6/1988 | Japan . |

*Primary Examiner*—Marvin M. Lateef

[57] ABSTRACT

In a potentiometer applied to the EGR system in automobiles, a relative motion between a printed circuit card and a holder, through which the card is slidably inserted, is blocked to prevent unwanted wear of a resistor on the printed circuit card when the potentiometer is subjected to vibrations from the EGR valve that may occur when the valve is on the verge of being opening, i.e., when the measured value is in the minimum range. The relative motion is prevented either by inserting an elastic member between the holder and the printed circuit card; by forming the spring seat of the holder—which is always urged by a spring toward the shaft and also restricted by a stopper—inclined with respect to the holder's sliding direction so that the holder is applied with an uneven spring load and is inclined to firmly hold the card with its ends; or by installing a spring between the upper end of the shaft and the facing end of the holder to absorb the vibration. The relative motion is also prevented by installing a spring between the bottom of the potentiometer case and the upper end of the shaft inside the case to urge the shaft to engage with the lower end of the holder. This keeps the shaft parted from the valve when the valve opening is the minimum.

4 Claims, 8 Drawing Sheets

POTENTIOMETER

BACKGROUND OF THE INVENTION

1. Field of the Invention

The present invention relates to a potentiometer.

2. Description of the Prior Art

In automobiles an EGR (exhaust gas recirculation) system is a known and effective technology to reduce emissions, particularly $NO_x$ (oxides of nitrogen), from the exhaust gas. The EGR system circulates an inert exhaust gas to the air intake side of the engine and, depending on a ratio between the amount of recirculated exhaust gas and the amount of intake air, or EGR ratio, the burning condition of fuel in the engine varies greatly, affecting the output of the engine, fuel cost and drivability. For optimum engine condition, a delicate and fine control is performed on the EGR system, such as increasing the EGR ratio under a driving condition where the amount of $NO_x$ is large and cutting the recirculation of exhaust gas when the exhaust gas recirculation is not needed. For this control, a technology has been realized in which the opening degree or lift of the EGR valve for recirculated exhaust gas is preselected for each driving condition and stored in a PROM as an output of a potentiometer, and in which the EGR valve is controlled by a microcomputer during engine operation so that the actually measured output of the potentiometer will agree with the output of the stored valve lift.

Since the EGR valve is operating at all times according to the driving pattern of the car, the EGR valve and the potentiometer, which measures the opening degree of the EGR valve for electrically determining the amount of recirculated exhaust gas, are required to withstand a significantly large frequency of operations. Other capabilities required of the EGR valve and the potentiometer are to withstand vibrations of a wide oscillation band from 20 Hz to 1 kHz coming from the engine and car body and accelerations as large as 30 G.

FIGS. 8 and 9 show conventional potentiometers as applied to the EGR system, disclosed in the Japanese Patent Publication No. Heisei 1-38245. In the figures, reference numeral 1' represents a potentiometer, 101 an EGR valve, 2 a potentiometer case, 3 a flange provided to one end of the case 2, 4 an O-ring installed in a groove 5 of the flange 3, 6 a fixing hole cut in the flange 3, and 7 a shaft slidably inserted in one end of the case 2. The shaft 7 is formed of such plastic as polyphenylene sulfide resin that has good lubricating performance, good rigidity and light weight.

Denoted 8 are connecting wires. Designated 102 is a housing of the EGR valve that has a passage 103 formed therein and a valve seat 104 installed in the passage 103. The housing is connected at an inlet 105 of the passage 103 with an engine exhaust pipe to receive exhaust gas and at an outlet 106 is connected with an air intake system of the engine. Designated 107 is a needle valve which has a valve 109 at the inner end to open and close the valve seat 104 to control the flow of the recirculated exhaust gas. At the upper end the housing 102 has a cup-shaped portion **102*a* formed integral therewith whose periphery is fitted with one end of an EGR valve case 110 with a diaphragm 109 clamped between. The end of the needle valve 107 is passed through and fixed to the center of the diaphragm 109. The diaphragm 109 and the case 110 together define an enclosed space, a negative pressure chamber 111, in which is installed a spring 113 between the case 110 and a press plate 112 mounted on the diaphragm 109. The case 110 is soldered at the upper end with a flange 114. One end of a case 2 of the potentiometer 1' is inserted airtightly into the end of the case 110. The flange 114 is formed with threaded holes at positions corresponding to the fixing holes 6 of the flange 3. Bolts are inserted and screwed into the threaded holes and the fixing holes 6 to fasten the two flanges 3, 114 together so that the potentiometer 1' is firmly mounted on the EGR valve 101 with an O-ring 4 clamped between. In this condition, the lower end of the shaft 7 is in contact with the upper end of the needle valve 107**.

The case 2 has a through-hole **2*a* at one end for the shaft 7 and the other end of the case is open. A plate 9 is installed in the open end of the case 2. Between a recess 2*b* formed in the end of the case 2 and a recess 9*a* formed in the plate 9 is fixedly installed a printed circuit card 10 which has a resistor 10*a* printed on one side thereof. A terminal 11 which is folded to provide an elasticity and formed as a 3-pin terminal is inserted and fixed in the recess 9*a*. The end of the printed circuit card 10 is inserted between a guide projection 9*b* formed in the recess 9*a* and the terminal 11 against the elastic force of the terminal 11 to electrically connect the resistor 10*a* to the terminal 11. A voltage is applied between the ends of the printed circuit card. The terminal 11 is connected to the connecting wire 8**.

Denoted 12 is a holder which is installed inside the case 2 so as to be slidable with respect to the inner wall of the case 2 in the direction of arrow C. The holder 12 engages with the end of the shaft and has the printed circuit card 10 passed therethrough. Around the insertion portion of the holder 12 through which the card 10 is passed are formed axially elongate guide portions **12*a*, 2*b*. Designated 12*d* is a gap between the printed circuit card 10 and the guide portions 12*a*, 12*b*. A metallic wiper 13 is attached to the holder 12 in such a way that it is in sliding contact with the resistor 10*a* of the printed circuit card 10 to collect current. A spring 14 is installed between the plate 9 and a spring seat 12*c* of the holder 12. The case 2, plate 9 and printed circuit card 10 as well as the shaft 7 and holder 12** are formed of resin.

Next, the operation of the potentiometer 1' and the EGR valve 101 of the above construction will be described. First, referring to FIG. 8, in the EGR valve the opening degree or lift of the valve 108 is determined by the difference between a force produced by the negative pressure in the chamber 111 that tends to push up the diaphragm 109 and a force of the spring 113 tending to push down the diaphragm 109. The valve lift in turn determines the amount of recirculated exhaust gas. The shaft 7 of the potentiometer 1' is pressed downwardly in FIG. 8 by the spring 4 through the holder 12. The end of the shaft 7 therefore is engaged with the end of the needle valve 107 so that the shaft 7 follows the motion of the needle valve 107. In other words, the shaft 7 exhibits a motion proportional to the opening degree of the valve 108. The holder 12 that engages with the shaft 7 moves with it, causing the wiper 13 to slide on the resistor **10*a* to divide the supply voltage thus producing an output proportional to the opening of the valve 108. Hence, when the valve 108 rests on the valve seat 109, closing the passage 103 and stopping the recirculation of the exhaust gas, the output of the potentiometer 1' is close to zero volt. When, on the other hand, the valve 108 is fully open to allow the maximum flow of recirculated gas, the output of the potentiometer 1' is close to the supply voltage. At an intermediate opening of the valve 108**, the potentiometer output is proportional to the valve opening.

Because of the construction described above, the conventional potentiometer is subjected to vibrations of engine while it follows the motion of the EGR valve that responds to the driving pattern of the automobile. If the vibration is large, the holder 12 and the printed circuit card 10 move relative to each other in the gap **12*d* causing the wiper 13 to slide back and forth on the resistor 10*a* by a small margin, accelerating wear of the resistor 10*a*. When the negative pressure in the negative pressure chamber 171 increases and the difference between the opposing forces produced by the negative pressure and the spring 113 becomes small, the contact pressure between the valve 108 and the valve seat 104 decreases, causing a surging between the valve 108 and the valve seat 14 by vibrations. The impact of the oscillating motion of the valve 108 is transmitted through the needle valve 107 and shaft 7 to the holder 12, generating a rapid sliding motion of the wiper 13 and the resistor 10*a*. As a result, the resistor 10*a* rapidly wears. As the resistor 10*a*** wears off, its resistance changes, which in turn causes substantial deviations in the correspondence between the resistance and the valve lift, making precise measurement of the amount of recirculated gas impossible. This means the exhaust gas recirculation is not performed correctly according to the running condition of the engine, increasing the amount of $NO_x$ in the exhaust gas.

SUMMARY OF THE INVENTION

The present invention has been accomplished to overcome the above-mentioned drawback experienced with the conventional potentiometers. The primary object of the invention is to provide a potentiometer which is capable of performing highly accurate recirculation of exhaust gas by reducing wear of the resistor.

To achieve the above objective, a first potentiometer of this invention comprises: a case having a through-hole at one end; a shaft slidably inserted through the through-hole in the case; a printed circuit card fixedly installed in the case and having a resistor on one surface thereof, said resistor being applied with a voltage at both ends; a holder installed in the case so as to be slidable on the inner wall of the case, said holder being engaged at one end with the end of the shaft inside the case, said holder receiving the printed circuit card so that the card can be slidably moved through the holder; a wiper mounted to the holder and kept in a sliding contact with the resistor on the printed circuit card to divide the voltage applied and thereby produce an output representing the amount of distance traveled by the shaft; a spring urging the holder toward the shaft; and an elastic member inserted in a gap between the holder and the printed circuit card.

A second potentiometer according to this invention is the first potentiometer which has the other end of the holder formed inclined with respect to the holder sliding direction.

A third potentiometer according to this invention is the first potentiometer which also includes a spring for urging the shaft toward the holder and a stopper for keeping the holder at a specified position on one end of the case.

A fourth potentiometer according to this invention is the first potentiometer which also includes a spring installed between the shaft and the holder and a stopper for keeping the holder at a specified position on one end of the case.

In the first potentiometer of this invention, since the elastic member presses the holder fixedly against the printed circuit card, the relative motion between the holder and the printed circuit card, i.e., between the wiper and the resistor does not occur even when the potentiometer is subjected to vibrations, thus eliminating wear of the resistor on the printed circuit card. This ensures a stable output at all times.

In the second potentiometer of the invention, since the holder with the inclined end is acted upon by an uneven spring force, which tends to incline the holder as it urges the holder toward the shaft, the ends of the insertion portion of the holder fixedly grip the printed circuit card. As a result, no relative motion will occur between the holder and the card even when the potentiometer is subjected to vibrations. This protects the resistor on the printed circuit card from wear and therefore ensures a stable output from the potentiometer at all times.

In the third potentiometer of the invention, the stopper restricts the position of the holder, the spring urges the shaft toward the holder to make it engage with the holder so that when the measured value is minimum, the shaft is parted a specified distance from the valve shaft being measured. This prevents the vibration of the valve shaft from being transmitted to the shaft of the potentiometer. As a result, no relative motion occurs between the holder and the printed circuit card, preventing the resistor on the card from being worn and thus producing a stable output at all times.

In the fourth embodiment of the invention, when the holder is pressed against the stopper, the spring urges the shaft in the direction opposite to the holder to separate the shaft and the holder from each other. In this condition, even when the vibration of the valve shaft being measured is transmitted to the shaft of the potentiometer, the vibration is absorbed by the spring interposed between the potentiometer shaft and the valve shaft and therefore is not transmitted to the holder. This prevents the relative motion between the holder and the printed circuit card, protecting the resistor on the card from being worn and ensuring a stable output at all times.

DETAILED DESCRIPTION OF PREFERRED EMBODIMENT

Figure 8:
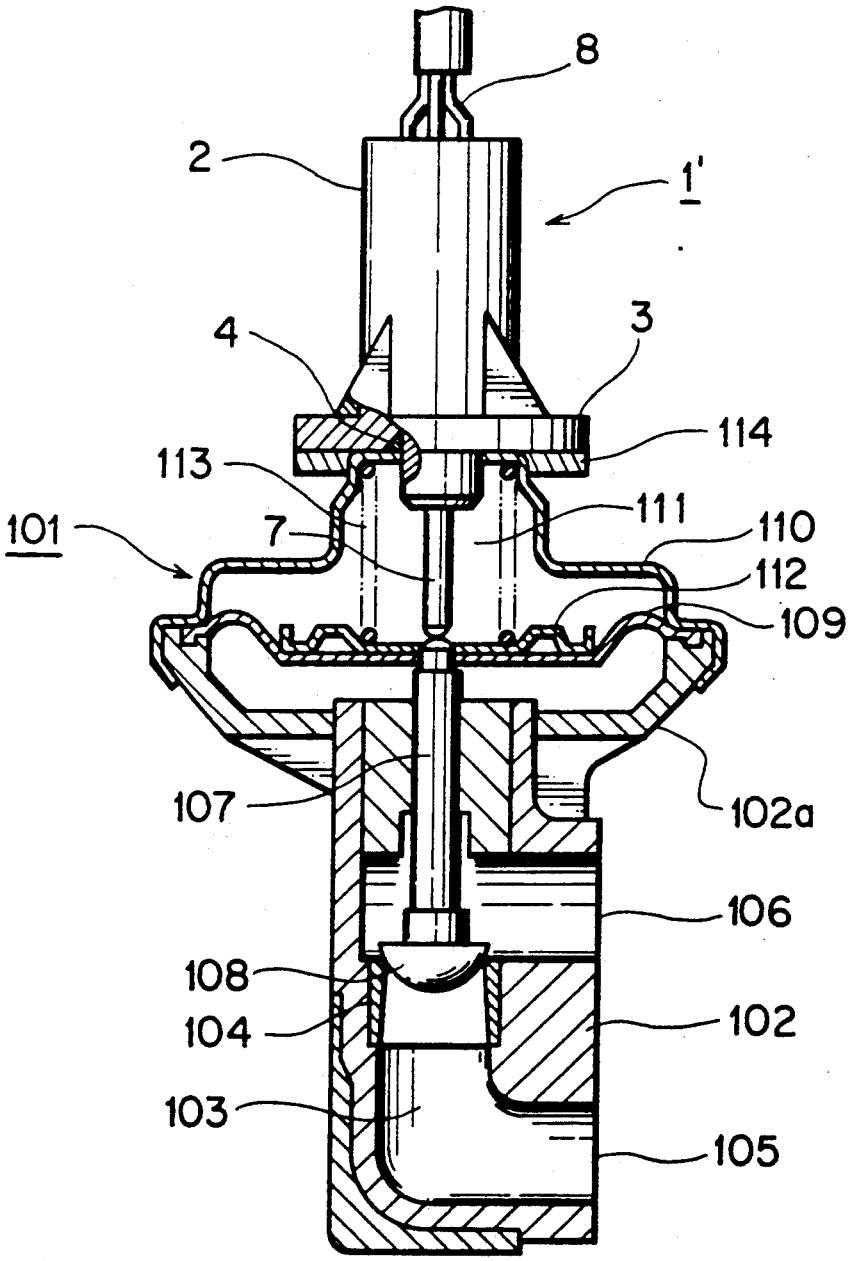
FIG. 8 PRIOR ART
FIG. 8 is a partial cross section of a conventional potentiometer as applied to the EGR system.
Figure 9:
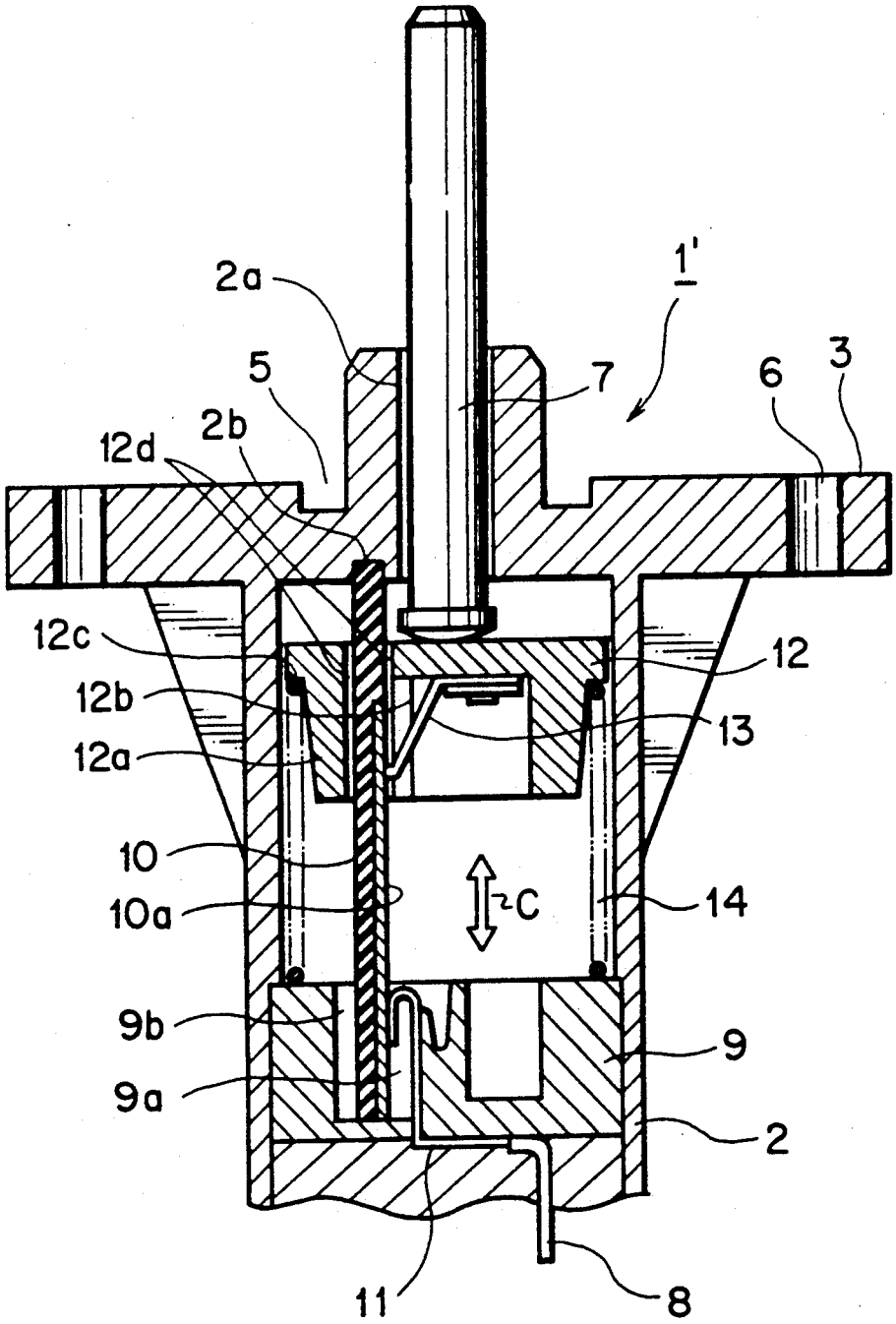
FIG. 9 PRIOR ART
FIG. 9 is a cross section of the conventional potentiometer.

Some preferred embodiments of this invention will be described by referring to the accompanying drawings. FIGS. 1 through 7 represent first to fifth embodiments of the invention. In these figures, components identical with those shown in FIGS. 8 and 9 are given like reference numerals and their explanations are omitted. In partial cross sections of the potentiometers, portions that are not shown are identical in construction with those of FIG. 9.

Figure 1:
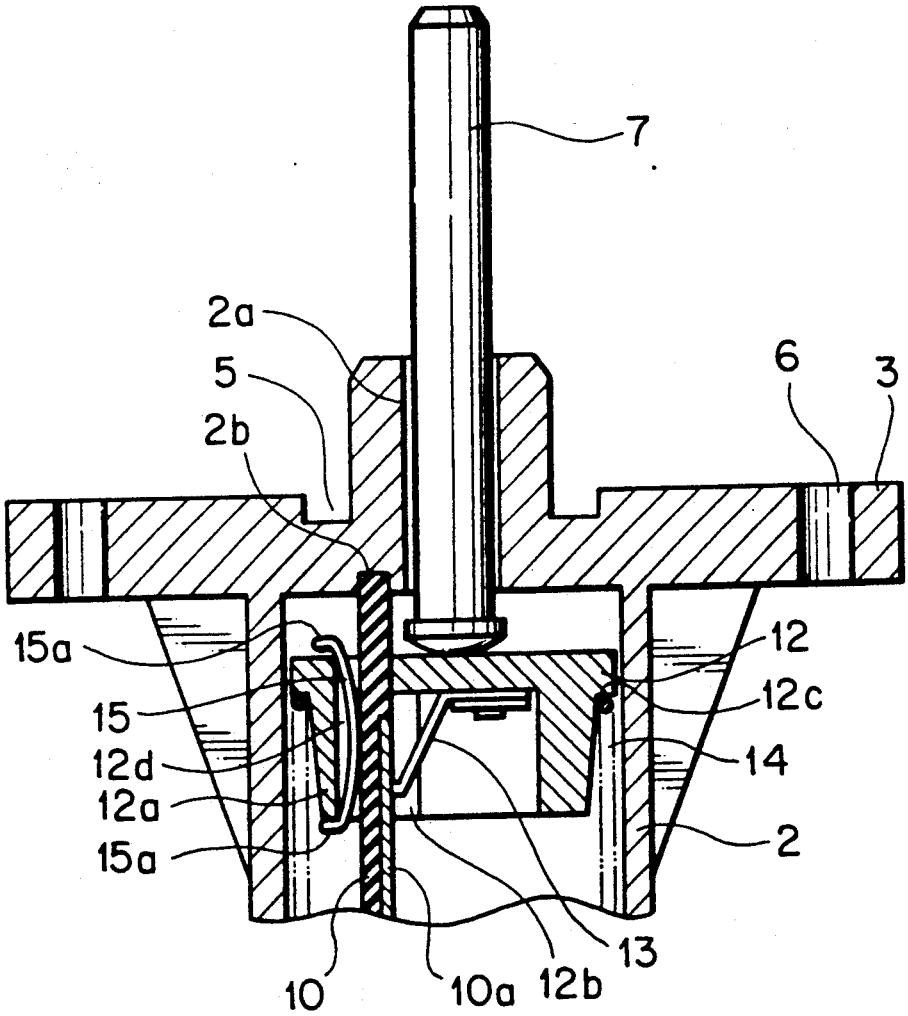
FIG. 1 is a partial cross section of a potentiometer as a first embodiment of this invention.

FIG. 1 shows a cross section of an essential portion of the potentiometer as a first embodiment of the invention. In the FIGURE, reference numeral 15 indicates a leaf spring installed in the insertion gap 12*d* between the holder 12 and the printed circuit card 10. The leaf spring 15 is inserted on a side of the printed circuit card 10 opposite to the holder 12 and the resistor 10*a* and presses the guide portion 12*b* of the holder 12 against the printed circuit card 10 so that the wiper 13 attached to the holder 12 is in pressing contact with the sliding surface of the resistor 10*a* on the card 10.

Denoted 15*a* is an engagement portion formed at both ends of the leaf spring 15 to prevent the leaf spring 15 from coming off the insertion gap 12*d*.

Next, the operation of the potentiometer with the above construction will be explained by referring to FIG. 1. When the potentiometer is subjected to vibrations from engine, the holder 12 is applied with a force corresponding to the vibrating acceleration. However, since the leaf spring 15 presses the guide portion 12*b* of the holder 12 fixedly against the printed circuit card 10, the relative motion between the printed circuit card 10 and the holder 12, i.e., between the resistor 10*a* and the wiper 13 can be prevented, substantially reducing the wear of the resistor 10*a*. The pressing force of the leaf spring 15 is appropriately adjusted according to the vibrating acceleration applied to the potentiometer.

In the above embodiment, although the leaf spring 15 is installed on the side of the printed circuit card 10 opposite to the guide portion 12*a*, it may be mounted on the same side of the card 10 as the guide portion 12*a* to produce the same effect.

Figure 2:
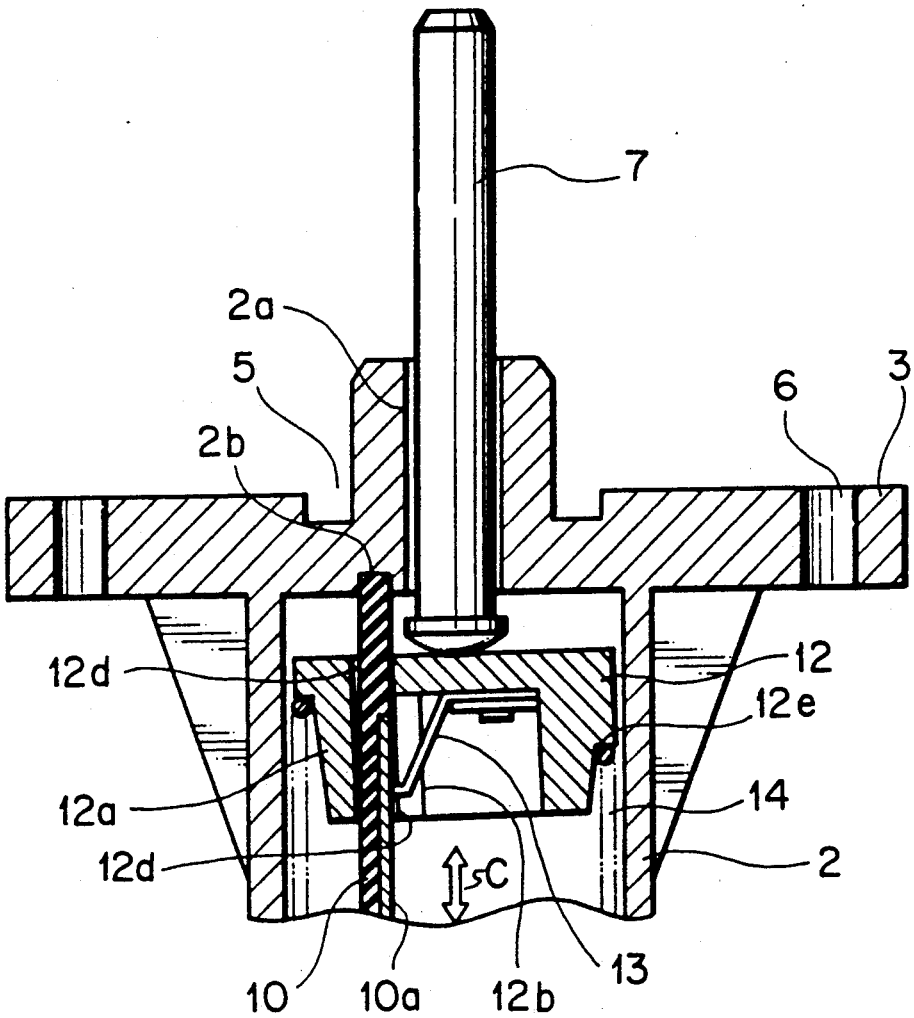
FIG. 2 is a partial cross section of a potentiometer as a second embodiment of the invention.
Figure 3:
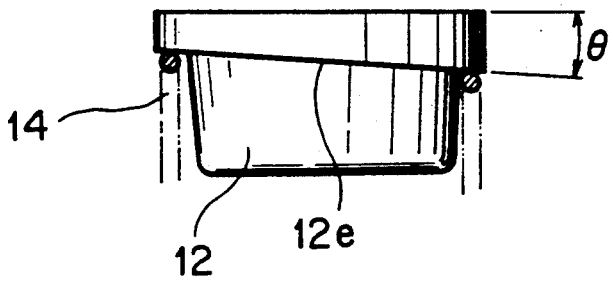
FIG. 3 is a schematic view of an essential portion of the second embodiment.

FIGS. 2 and 3 represent a second embodiment of the invention, FIG. 2 showing a partial cross section of an essential portion of the potentiometer and FIG. 3 showing a schematic view of an essential portion of the potentiometer. In these figures, reference numeral 12*e* represents a spring seat of the holder 12, which is formed inclined with respect to the sliding direction of the holder 12 (indicated by the arrow C) to apply an uneven load from the spring 14 to the spring seat 12*e*. When applied with the uneven spring load, the center axis of the holder 12 becomes slanted with respect to the sliding direction and the printed circuit card 10 is gripped by the ends of the guide portions 12*a*, 12*b* of the holder 12, which form an insertion portion for the card 10.

Now, we will explain about the operation of the second embodiment by referring to FIGS. 2 and 3. In the potentiometer with the construction of FIG. 2, when vibrations of the engine are transmitted to the potentiometer, a force corresponding to the vibrating acceleration is applied to the holder 12. Because the printed circuit card 10 is held by the ends of the guide portions 12*a*, 12*b* on the strength of the uneven load of the spring 14, which is caused by the spring seat 12*e* being inclined with respect to the sliding direction of the holder 12, the relative motion between the holder 12 and the printed circuit card 10 is prevented, substantially reducing wear of the resistor 10*a*.

The angle of inclination $\theta$ of the spring seat 12*e* is appropriately adjusted according to the vibration acceleration so that there will be no relative motion between the holder 12 and the printed circuit card 10.

While in the above embodiment the spring seat 12*e* is inclined, it is also possible to incline the end portion of the spring 14 rather than inclining the spring seat and have the same effect.

Figure 4:
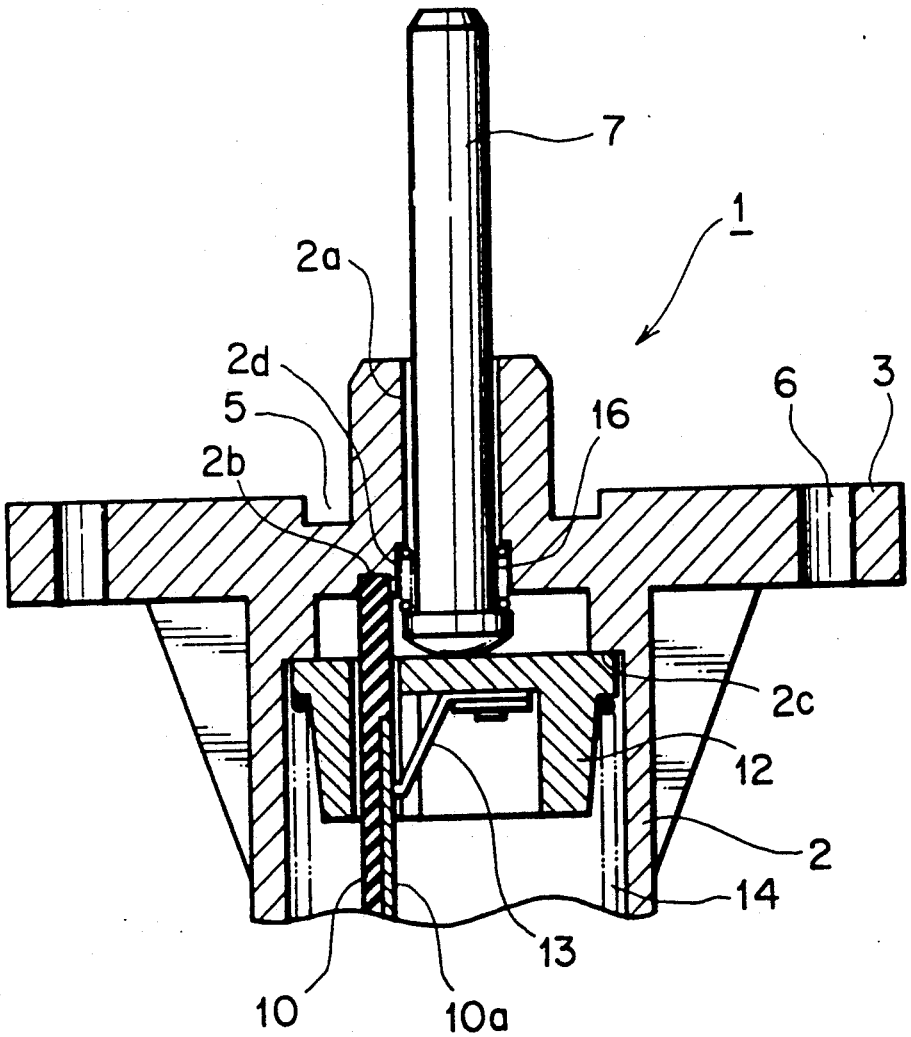
FIG. 4 is a partial cross section of a potentiometer as a third embodiment of the invention.
Figure 5:
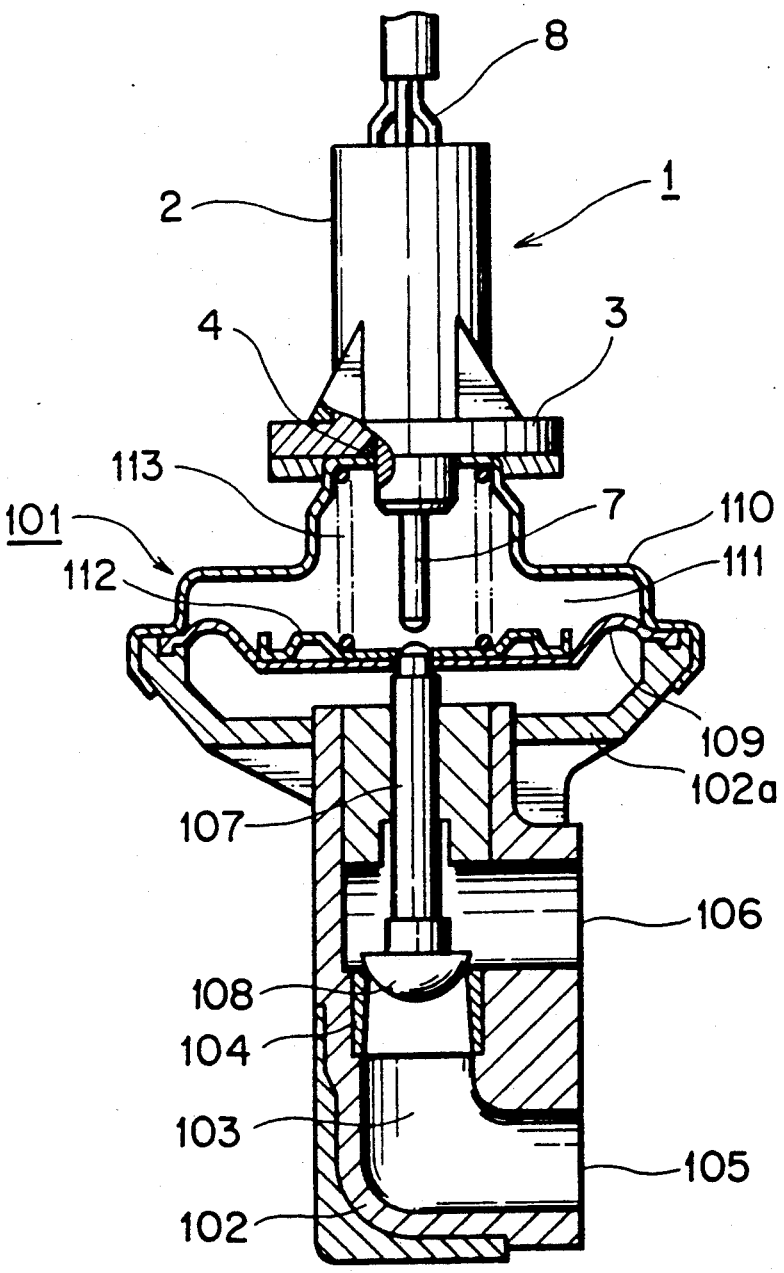
FIG. 5 is a partial cross section of the potentiometer of FIG. 4 as applied to the EGR system.

FIGS. 4 and 5 represent a third embodiment of the invention, FIG. 4 showing a cross section of an essential portion of the potentiometer and FIG. 5 showing a partial cross section of the potentiometer of FIG. 4 mounted to the EGR valve. In FIG. 4, denoted 2*c* is a stopper integrally formed with the bottom of the case 2 whose inner diameter is made smaller than the outer diameter of the holder 12. The end surface of the holder 12 is pressed against the stopper 2*c*. Designated 2*d* is a recess for accommodating a spring which is formed in the through-hole 2*a* of a case 2 on the holder 12 side. The spring accommodating recess 2*d* is larger in inner diameter than the through-hole 2*a*. A coil spring 16 is installed in the spring accommodating recess 2*d* to urge the shaft 7 from the end of the stopper 2*c* toward the holder 12. The force of the coil spring 16 is set smaller than that of the spring 14.

Now, let us turn to the operation of the third embodiment by referring to FIGS. 4 and 5. In the potentiometer 1 with the above construction, when the valve 108 is closed as shown in FIG. 5, the ends of the shaft 7 and the needle valve 107 are out of contact with a certain gap between. This is because, as shown in FIG. 4, the holder 12 is pressed against the stopper 2*c* by the force of the spring 14 greater than that of the spring 16, with the shaft 7 urged and lifted by the coil spring 16 until it engages with the end surface of the holder 12.

As the negative pressure in the negative pressure chamber 111 increases and the upward force acting on the diaphragm 109 almost balances with the opposing force of the spring 113, the contact pressure between the valve 108 and the valve seat 104 decreases, giving rise to a surging that may occur between the valve 108 and the valve seat 104 due to the engine vibrations. However, with this construction, the vibration due to surging is not transmitted through the needle valve 107 to the shaft 7 because of the gap between. Therefore there will be no relative motion between the holder 12 and the printed circuit card 10, contributing to a significant reduction in wear of the resistor 10*a*.

The distance between the ends of the shaft 7 and the needle valve 107 is preferably set to the minimum value that prevents transmission of surging vibrations to the shaft 7.

When the negative pressure in the negative pressure chamber 111 further increases, allowing the valve 108 to open to a certain degree, the end of the needle valve 107 comes into contact with the shaft 7 to lift the shaft 7 and drive it in the same way as do the conventional EGR valve.

Figure 6:
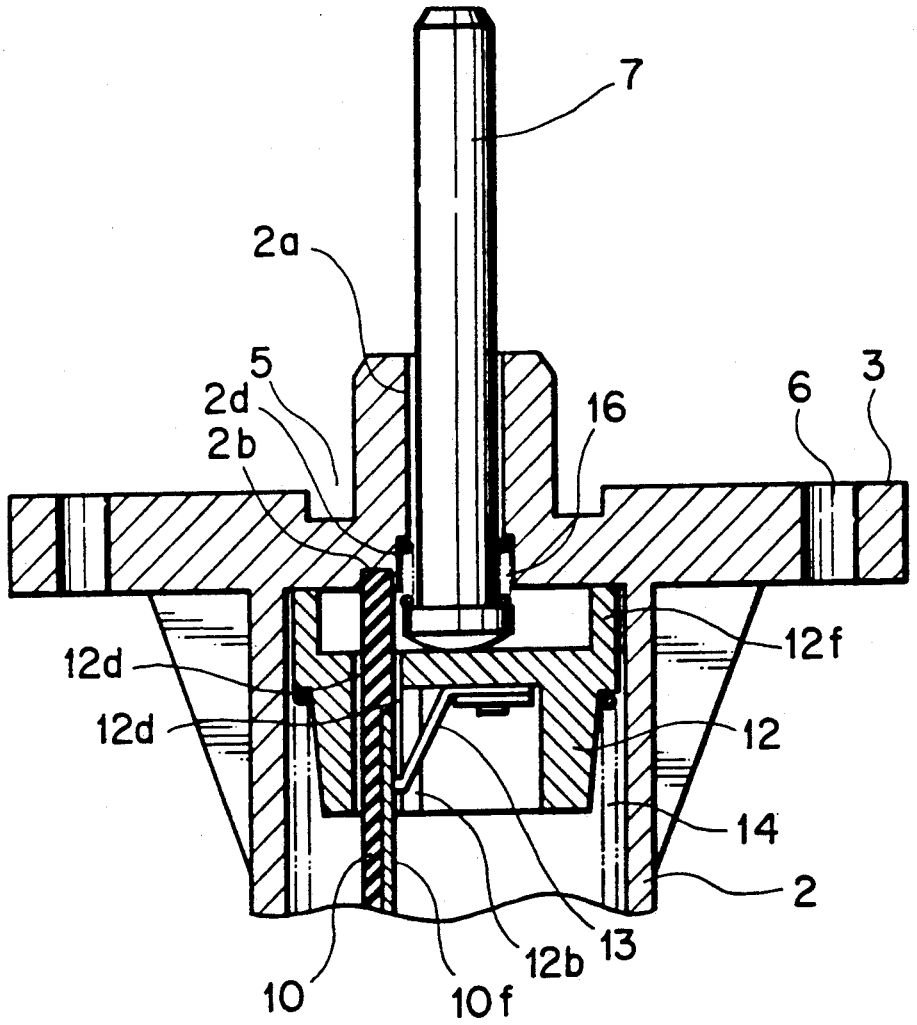
FIGS. 6 and 7 are partial cross sections of potentiometers as fourth and fifth embodiments of the invention.

FIG. 6 shows a cross section of an essential portion of a potentiometer as a fourth embodiment of the invention. In the FIGURE, what differs from the third embodiment is that a projecting stopper 12*f* is provided to the holder 12 on the side of the shaft 7 to restrict the movement of the holder 12 toward the shaft 7 when it is pressed against the bottom of the housing 2. Even with the initial lift of the shaft 7 toward the holder 12 restricted, this fourth embodiment has the similar effects to the third embodiment.

Figure 7:
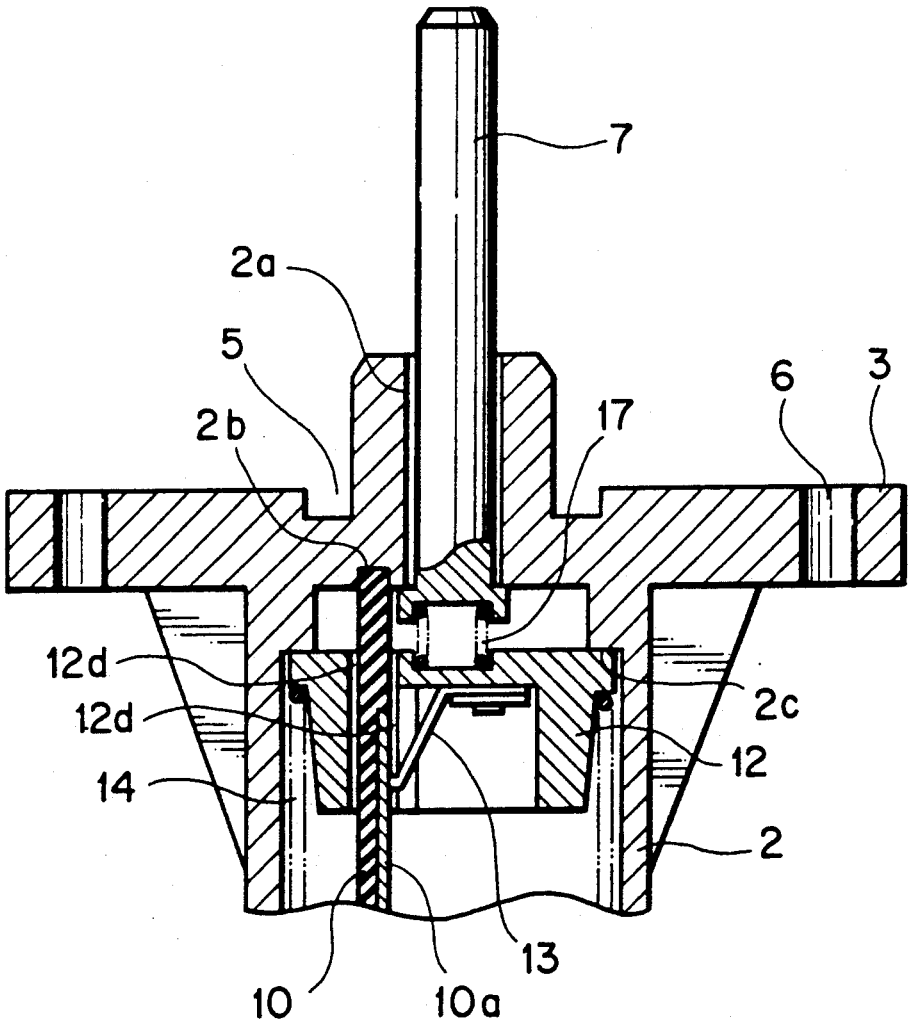

FIG. 7 shows a cross section of an essential portion of a potentiometer as a fifth embodiment of the invention. In the FIGURE, the facing end surfaces of the shaft 7 and the holder 12 are formed with recesses, between which a coil spring 17 is installed. A stopper 2c is provided to the bottom of the case 2. The force of the spring 14 is set larger than that of the coil spring 17. The end of the shaft 7, which engages with the coil spring 17, is formed larger in diameter than the through-hole 2a to serve as a stopper. These potentiometers are used in place of the conventional potentiometer 1' of FIG. 8.

Next, by referring to FIGS. 7 and 8, we will explain about the operation of the fifth embodiment. When the valve 108 is closed, the holder 12 is pressed against the stopper 2c by the force of the spring 14 that urges the holder 12 toward the shaft 7. The coil spring 17 keeps the shaft 7 away from the holder 12 and at the same time in contact with the end of the needle valve 107. In this state, as the negative pressure in the negative pressure chamber 111 increases and the upward force of the negative pressure acting on the diaphragm 109 is almost balanced with the opposing force of the spring 113, the contact pressure between the valve 108 and the valve seat 104 decreases. Engine vibrations transmitted causes surging at the contact surface between the valve 108 and the valve seat 104. The vibration of the surging is transmitted to the shaft 7 but is absorbed by the coil spring 17 so that the vibration is not conveyed to the holder 12. Thus, there is no relative motion between the printed circuit card 10 and the holder 12, substantially reducing wear of the resistor 10a. As the negative pressure in the negative pressure chamber 111 further increases, the valve 108 parts from the valve seat 104. The needle valve 107 is then lifted to cause the shaft 7 to engage with the holder 12, resulting in the sliding motion of the holder—a voltage dividing operation along the resistor 10a which is performed the same way as the conventional potentiometer.

As mentioned above, the potentiometer of this invention has either a resilient member installed in an insertion gap between the holder and the printed circuit card or the upper end of the holder—where it receives the spring force—formed inclined with respect to the direction of holder vibration to keep the holder tilted thereby bringing the holder and the printed circuit card fixedly together at the ends of the insertion portion of the holder. When the potentiometer of this construction is applied to the EGR system, the wear of the resistor on the printed circuit card can be prevented even when the potentiometer is subjected to the engine vibrations because the holder and the printed circuit card are fixedly held together to prevent their relative motion. This ensures a voltage output of the potentiometer which is a good representation of the valve lift, making precise EGR operation possible.

Another advantage of the invention is that since the potentiometer is provided with a spring urging the shaft toward the holder and with a stopper to keep the holder at a specified position, the shaft is parted a specified distance from the needle valve when the needle valve is closed in the EGR system. This prevents the vibration of the needle valve from being transmitted to the shaft of the potentiometer, which in turn prevents relative motion between the holder and the printed circuit card, thus offering the same effects as the above embodiment.

Furthermore, since a spring is provided between the shaft and the holder and a stopper is provided to keep the holder at a specified position, the vibration of the needle valve, even when it happens to be transmitted to the shaft, is absorbed by the spring between the shaft and the holder, thus preventing the relative motion between the holder and the printed circuit card and offering the same effect as the above embodiment.

What is claimed is:

1. A potentiometer comprising:

a case having a through-hole at one end;

a shaft slidably inserted through the through-hole in the case;

a printed circuit card fixedly installed in the case and having a resistor on one surface thereof, said resistor being applied with a voltage at both ends;

holder installed in the case so as to be slidable on the inner wall of the case, said holder being engaged at one end with the end of the shaft inside the case, said holder receiving the printed circuit card so that the card can be slidably moved through the holder;

a wiper mounted to the holder and kept in a sliding contact with the resistor on the printed circuit card to divide the voltage applied and thereby produce an output representing the amount of distance traveled by the shaft;

a spring urging the holder toward the shaft; and an elastic member inserted in a gap between the holder and the printed circuit card.

2. A potentiometer comprising:

a case having a through-hole at one end;

a shaft slidably inserted through the through-hole in the case;

a printed circuit card fixedly installed in the case and having a resistor on one surface thereof, said resistor being applied with voltage at both ends;

a holder installed in the case so as to be slidable on the inner wall of the case, said holder being engaged at one end with the end of the shaft inside the case, said holder receiving the printed circuit card so that the card can be slidably moved through the holder;

a wiper mounted to the holder and kept in a sliding contact with the resistor on the printed circuit card to divide the voltage applied and thereby produce an output representing the amount of distance traveled by the shaft; and a spring acting on the other end of the holder to urge it toward the shaft, said other end being formed inclined with respect to the sliding direction of the holder.

3. A potentiometer comprising:

a case having a through-hole at one end;

a shaft slidably inserted through the through-hole in the case;

a printed circuit card fixedly installed in the case and having a resistor on one surface thereof, said resistor being applied with voltage at both ends;

a holder installed in the case so as to be slidable on the inner wall of the case, said holder being engaged at one end with the end of the shaft inside the case, said holder receiving the printed circuit card so that the card can be slidably moved through the holder;

a wiper mounted to the holder and kept in a sliding contact with the resistor on the printed circuit card to divide the voltage applied and thereby produce an output representing the amount of distance traveled by the shaft;

a spring urging the holder toward the shaft;

a spring urging the shaft toward the holder; and a stopper for restricting the holder at a specified position on one end of the case.

4. A potentiometer comprising:

a case having a through-hole at one end;

a shaft slidably inserted through the through-hole in the case;

a printed circuit card fixedly installed in the case and having a resistor on one surface thereof, said resistor being applied with voltage at both ends;

a holder installed in the case so as to be slidable on the inner wall of the case, said holder receiving the printed circuit card so that the card can be slidably moved through the holder;

a wiper mounted to the holder and kept in a sliding contact with the resistor on the printed circuit card to divide the voltage applied and thereby produce an output representing the amount of distance traveled by the shaft;

a spring urging the holder toward the shaft;

a spring installed between the shaft and the holder; and a stopper for restricting the holder at a specified position on one end of the case.

* * * * *